US012319994B2

(12) United States Patent
Meyer et al.

(10) Patent No.: US 12,319,994 B2
(45) Date of Patent: Jun. 3, 2025

(54) METHOD OF PRODUCING A HIGH-ENERGY HYDROFORMED STRUCTURE FROM A 7XXX-SERIES ALLOY

(71) Applicant: Airbus SAS, Blagnac (FR)

(72) Inventors: Philippe Meyer, Koblenz (DE); Sunil Khosla, Koblenz (DE); Achim Bürger, Koblenz (DE); Sabine Maria Spangel, Koblenz (DE); Andreas Harald Bach, Koblenz (DE)

(73) Assignee: AIRBUS SAS, Blagnac (FR)

( * ) Notice: Subject to any disclaimer, the term of this patent is extended or adjusted under 35 U.S.C. 154(b) by 723 days.

(21) Appl. No.: 17/273,067

(22) PCT Filed: Sep. 4, 2019

(86) PCT No.: PCT/EP2019/073548
§ 371 (c)(1),
(2) Date: Mar. 3, 2021

(87) PCT Pub. No.: WO2020/049027
PCT Pub. Date: Mar. 12, 2020

(65) Prior Publication Data

US 2021/0340655 A1 Nov. 4, 2021

(30) Foreign Application Priority Data

Sep. 5, 2018 (EP) ..... 18192734

(51) Int. Cl.
*C22F 1/053* (2006.01)
*B21D 26/027* (2011.01)
*C22C 21/10* (2006.01)

(52) U.S. Cl.
CPC ..... *C22F 1/053* (2013.01); *B21D 26/027* (2013.01); *C22C 21/10* (2013.01)

(58) Field of Classification Search
None
See application file for complete search history.

(56) References Cited

U.S. PATENT DOCUMENTS 6,105,409 A * 8/2000 Kojima ..... B21D 37/02 72/58
7,610,669 B2 * 11/2009 Keidel ..... C22C 21/10 29/897

(Continued)

FOREIGN PATENT DOCUMENTS

EP 3275567 A1 1/2018
KR 101069023 * 9/2011
WO 2014159647 A1 10/2014

OTHER PUBLICATIONS

Cerutti, X. et al. "Numerical modeling and mechanical analysis of the machining of large aeronautical parts." 2015. Ecole Nationale Superieure des Mines de Paris. (Year: 2015).*

(Continued)

*Primary Examiner* — Nicholas A Wang
(74) *Attorney, Agent, or Firm* — Greer, Burns & Crain, Ltd.

(57) ABSTRACT

A method of producing an integrated monolithic aluminum structure, the method includes the steps of: (a) providing an aluminum alloy plate with a predetermined thickness of at least 38.1 mm, wherein the aluminum alloy plate is a 7xxx-series alloy provided in an F-temper or an O-temper; (b) optionally pre-machining of the aluminum alloy plate to an intermediate machined structure; (c) high-energy hydroforming of the plate or optional intermediate machined structure against a forming surface of a rigid die having a contour in accordance with a desired curvature of the integrated monolithic aluminum structure, the high-energy hydroforming causing the plate or the intermediate machined structure to conform to the contour of the forming (Continued)

surface to at least one of a uniaxial curvature and a biaxial curvature; (d) solution heat-treating and cooling of the high-energy hydroformed structure; (e) machining and (f) ageing of the final integrated monolithic aluminum structure.

16 Claims, 3 Drawing Sheets

(56) References Cited

U.S. PATENT DOCUMENTS

| | | | | |
|---|---|---|---|---|
| 2004/0055349 | A1* | 3/2004 | El-Soudani | B64C 1/12 72/56 |
| 2008/0173377 | A1* | 7/2008 | Khosla | C22F 1/057 148/552 |
| 2015/0376754 | A1 | 12/2015 | Yan et al. | |
| 2018/0230583 | A1 | 8/2018 | Luckey, Jr. et al. | |

OTHER PUBLICATIONS

International Search Report; priority document.

* cited by examiner

METHOD OF PRODUCING A HIGH-ENERGY HYDROFORMED STRUCTURE FROM A 7XXX-SERIES ALLOY

CROSS-REFERENCES TO RELATED APPLICATIONS

This application claims the benefit of the International Application No. PCT/EP2019/073548, filed on Sep. 4, 2019, and of the European patent application No. 18192734.4 filed on Sep. 5, 2018, the entire disclosures of which are incorporated herein by way of reference.

FIELD OF THE INVENTION

The invention relates to a method of producing an integrated monolithic aluminum alloy structure, and can have a complex configuration, that is machined to near-net-shape out of a plate material. More specifically, the invention relates to a method of producing an integrated monolithic aluminum alloy structure made from a 7xxx-series alloy, and can have a complex configuration, that is machined to near-net-shape out of a plate material. The invention relates also to an integrated monolithic aluminum alloy structure produced by the method of this invention and to several intermediate semi-finished products obtained by such method.

BACKGROUND OF THE INVENTION

U.S. Pat. No. 7,610,669-B2 (Aleris) discloses a method for producing an integrated monolithic aluminum structure, in particular an aeronautical member, comprising the steps of:

(a) providing an aluminum alloy plate with a predetermined thickness, the plate having been stretched after quenching and having been brought to a first temper selected from the group consisting of T4, T73, T74 and T76, wherein the aluminum alloy plate is produced from an AA7xxx-series aluminum alloy having a composition consisting of, in wt. %: 5.0-8.5% Zn, 1.0-2.6% Cu, 1.0-2.9% Mg, <0.3% Fe, <0.3% Si, optionally one or more elements selected from the group of Cr, Zr, Mn, V, Hf, Ti, the total of the optional elements not exceeding 0.6%, incidental impurities and the balance aluminum, (b) shaping the alloy plate by means of bending to obtain a predetermined shaped structure having a pre-machining thickness in the range of 10 to 220 mm, the alloy plate in the first temper selected from the group consisting of T4, T73, T74 and T76 to form the shaped structure having a built-in radius, (c) heat-treating the shaped structure, wherein the heat-treating comprises artificially aging the shaped structure to a second temper selected from the group consisting of T6, T79, T78, T77, T76, T74, T73 or T8, (d) machining the shaped structure to obtain an integrated monolithic aluminum structure as the aeronautical member for an aircraft, wherein the machining of the shaped structure occurs after the artificial ageing.

It is suggested that the disclosed method can be applied also to AA5xxx, AA6xxx and AA2xxx-series aluminum alloys.

Patent document US-2018/0230583-A1 discloses a method of forming a tubular vehicle body reinforcement, comprising providing a seam welded or extruded 7xxx aluminum tube, solution heat-treating by heating tube to at least 450° C., quenching the tube to less than 300° C. at a minimum rate of 300° C./s with no more than a 20 second delay between the heating and the quenching, preferably a pre-bending and a pre-forming operation to form the tube along its length to a desired shape, and hydroforming the tube within 8 hours of quenching, trimming and artificially ageing of the tube to provide a yield strength of more than 470 MPa. The tube may have an outer diameter of less than 5 inches and a wall thickness greater than 1.5 mm and less than 4 mm.

There is a demand for forming integrated monolithic aluminum structures of more complex configuration from a thick plate product.

SUMMARY OF THE INVENTION

As will be appreciated herein, except as otherwise indicated, aluminum alloy designations and temper designations refer to the Aluminium Association designations in Aluminium Standards and Data and the Registration Records, as published by the Aluminium Association in 2018 and are well known to the person skilled in the art. The temper designations are laid down in European standard EN515.

For any description of alloy compositions or preferred alloy compositions, all references to percentages are by weight percent unless otherwise indicated.

As used herein, the term "about" when used to describe a compositional range or amount of an alloying addition means that the actual amount of the alloying addition may vary from the nominal intended amount due to factors such as standard processing variations as understood by those skilled in the art.

The term "up to" and "up to about", as employed herein, explicitly includes, but is not limited to, the possibility of zero weight-percent of the particular alloying component to which it refers. For example, up to 0.5% Ag may include an aluminum alloy having no Ag.

"Monolithic" is a term known in the art meaning comprising a substantially single unit which may be a single piece formed or created without joint or seams and comprising a substantially uniform whole.

It is an object of the invention to provide a method of producing an integrated monolithic aluminum alloy structure of complex configuration that is machined to near-net-shape.

It is an object of the invention to provide a method of producing an integrated monolithic 7xxx-series aluminum alloy structure of complex configuration that is machined to near-net-shape out of thick gauge plate material.

These and other objects and further advantages are met or exceeded by the present invention providing a method of producing an integrated monolithic aluminum structure, the method comprising the process steps of, providing an aluminum alloy plate with a predetermined thickness of at least 38.1 mm (1.5 inches), wherein the aluminum alloy plate is a 7xxx-series alloy provided in an F-temper or an O-temper;

optionally pre-machining of the aluminum alloy plate to an intermediate machined structure;

high-energy hydroforming of the plate or the intermediate machined structure into a high-energy hydroformed structure against a forming surface of a rigid die having a contour at least substantially in accordance with a desired curvature of the integrated monolithic aluminum structure, the high-energy hydroforming causing the plate or the intermediate machined structure to substantially conform to the contour of the forming surface to at least one of a uniaxial curvature and a biaxial curvature;

solution heat-treating and cooling of the resultant high-energy hydroformed structure;

machining or mechanical milling of the solution heat-treated high-energy formed structure to a near-final or final machined integrated monolithic aluminum structure; and ageing of the integrated monolithic aluminum structure to a desired temper to develop the required strength and other engineering properties relevant for the intended application of the integrated monolithic aluminum structure.

It is an important feature of this invention that the 7xxx-series starting plate product employed is provided in an F-temper or in an O-temper.

"F-temper" means that the 7xxx-series starting plate product is as-fabricated, optionally incorporating a small stretching operation of up to about 1% to improve product flatness, and there are no mechanical properties specified. In the case at hand this means that the plate material has been cast into a rolling ingot, pre-heated and/or homogenized, hot-rolled, and optionally cold-rolled, to final gauge as is regular in the art but without or devoid of any further purposive annealing, solution heat-treatment or artificial ageing.

As is well-known in the art, "0-temper" means that the 7xxx-series starting plate product has been annealed to obtain lowest strength temper having more stable mechanical properties. In the case at hand this means that the plate material has been cast into a rolling ingot, pre-heated and/or homogenized, hot-rolled, and optionally cold-rolled, to final gauge as is regular in the art, optionally incorporating a small stretching operation of up to about 1% to improve product flatness. As is known in the art, a recommended annealing to obtain lowest strength temper typically comprises soaking for about 2 to 3 hours at about 405° C., cooling to about 205° C. or lower, reheat to about 232° C., and soak for about 4 hours, followed by cooling to ambient temperature and whereby the cooling rate to ambient temperature is not critical.

An F-temper or O-temper plate product as a starting material is favorable as it provides significantly more ductility during a subsequent high-energy hydroforming operation. Whereas high-energy hydroforming of plate material in, for example, a T6 or T7 temper having a higher strength and lower ductility, will lead to more springback and residual stress after the high-energy hydroforming operation.

In an embodiment in a next process step the 7xxx-series plate material is pre-machined, such as by turning, milling, and drilling, to an intermediate machined structure. Preferably the ultra-sonic dead-zone is removed from the plate product. And depending on the final geometry of the integrated monolithic aluminum structure some material can be removed to create one or more pockets in the plate material and a more near-net-shape to the forming die. This may facilitate the shaping during the subsequent high-energy hydroforming operation.

In an embodiment of the method according to this invention the high-energy hydroforming step is by means of explosive forming. The explosive forming process is a high-energy-rate plastic deformation process performed in water or another suitable liquid environment, e.g., an oil, to allow ambient temperature forming of the aluminum alloy plate. The explosive charge can be concentrated in one spot or distributed over the metal, ideally using detonation cords. The plate is placed over a die and preferably clamped at the edges. In an embodiment the space between the plate and the die may be vacuumed before the forming process.

Explosive-forming processes may be equivalently and interchangeably referred to as "explosion-molding", "explosive molding", "explosion-forming" or "high-energy hydroforming" (HEH) processes. An explosive-forming process is a metalworking process where an explosive charge is used to supply the compressive force (e.g., a shockwave) to an aluminum plate against a form (e.g., a mold) otherwise referred to as a "die". Explosive-forming is typically conducted on materials and structures of a size too large for forming such structures using a punch or press to accomplish the required compressive force. According to one explosive-forming approach, an aluminum plate, up to several inches thick, is placed over or proximate to a die, with the intervening space, or cavity, optionally evacuated by a vacuum pump. The entire apparatus is submerged into an underwater basin or tank, with a charge having a predetermined force potential detonated at a predetermined distance from the metal workpiece to generate a predetermined shockwave in the water. The water then exerts a predetermined dynamic pressure on the workpiece against the die at a rate on the order of milliseconds. The die can be made from any material of suitable strength to withstand the force of the detonated charge such as, for example, concrete, ductile iron, etc. The tooling should have higher yield strength than the metal workpiece being formed.

In an embodiment of the method according to this invention the high-energy hydroforming step is by means of electrohydraulic forming. The electrohydraulic forming process is a high-energy-rate plastic deformation process preferably performed in water or another suitable liquid environment, e.g., an oil, to allow ambient temperature forming of the aluminum alloy plate. An electric arc discharge is used to convert electrical energy to mechanical energy and change the shape of the plate product. A capacitor bank delivers a pulse of high current across two electrodes, which are positioned a short distance apart while submerged in a fluid. The electric arc discharge rapidly vaporizes the surrounding fluid creating a shock wave. The plate is placed over a die and preferably clamped at the edges. In an embodiment the space between the plate and the die may be vacuumed before the forming process.

A coolant is preferably used during the various pre-machining and machining or mechanical milling processes steps to allow for ambient temperature machining of the aluminum alloy plate or an intermediate product. Preferably wherein the pre-machining and the machining to near-final or final machined structure comprises high-speed machining, preferably comprises numerically-controlled (NC) machining.

Following the high-energy hydroforming step the resultant structure is solution heat-treated and cooled to ambient temperature. One of the objects is to heat the structure to a suitable temperature, generally above the solvus temperature, holding at that temperature long enough to allow soluble elements to enter into solid solution, and cooling rapidly enough to hold the elements as much as feasible in solid solution. The suitable temperature is alloy dependent and is commonly in a range of about 400° C. to 560° C. and can be performed in one step or as a multistep solution heat-treatment. The solid solution formed at high temperature may be retained in a supersaturated state by cooling with sufficient rapidity to restrict the precipitation of the solute atoms as coarse, incoherent particles.

The solution heat-treatment followed by cooling is important because of obtaining an optimum microstructure that is substantially free from grain boundary precipitates that deteriorate corrosion resistance, strength and damage tolerance properties and to allow as much solute to be available for subsequent strengthening by means of ageing.

For the 7xxx-series alloys having a purposive addition of Cu of at least 1.0%, the solution heat treatment temperature should be at least about 400° C. A preferred minimum temperature is about 450° C., and more preferably about 460° C., and most preferably 470° C. The solution heat-treatment temperature should not exceed 560° C. A preferred maximum temperature is about 530° C., and preferably not more than about 520° C.

In the embodiment of the 7xxx-series alloys having Cu up to 0.3%, the solution heat treatment temperature should be at least about 400° C. A preferred minimum temperature is about 430° C., and more preferably about 470° C. The solution heat-treatment temperature should not exceed 560° C. A preferred maximum temperature is about 545° C., and preferably not more than about 530° C.

In an embodiment of the method according to this invention following the solution heat-treatment the intermediate product is stress relieved, preferably by an operation including a cold compression type of operation, else there will be too much residual stress impacting a subsequent machining operation.

In an embodiment the stress relieve via a cold compression of operation is by performing one or more next high-energy hydroforming steps. Preferably applying a milder shock wave compared to the first high-energy hydroforming step creating the initial high-energy hydroformed structure.

In one embodiment the solution heat-treated high-energy formed intermediate structure, and optionally also stress relieved, is, in that order, next machined or mechanically milled to a near-final or final machined integrated monolithic aluminum structure and followed by ageing to a desired temper to achieve final mechanical properties.

In another more preferred embodiment, the solution heat-treated high-energy formed intermediate structure, and optionally also stress relieved, is, in that order, aged to a desired temper to achieve final mechanical properties and followed by machining or mechanical milling to a near-final or final machined integrated monolithic aluminum structure. Thus, the machining occurs after the ageing.

In both embodiments the ageing to a desired temper to achieve final mechanical properties is selected from the group of: T4, T5, T6, and T7. The ageing step preferably includes at least one ageing step at a temperature in the range of 120° C. to 210° C. for a soaking time in a range of 4 to 30 hours.

In a preferred embodiment the ageing to a desired temper to achieve final mechanical properties is to a T7 temper, more preferably a T73, T74 or T76 temper, more preferably a T7352, T7452 or T7652 temper.

In an embodiment the ageing is to a Tx54 temper and where x is equal to 3, 6, 73, 74 or 76, which represents a stress relieved temper with combined stretching and compression.

In an embodiment the final aged near-final or final machined formed integrated monolithic aluminum structure has a tensile strength of at least 300 MPa. In an embodiment the tensile strength is at least 360 MPa, and more preferably at least 400 MPa.

In an embodiment the final aged near-final or final machined formed integrated monolithic aluminum structure has a substantially unrecrystallized microstructure to provide to better balance in mechanical and corrosion properties.

In an embodiment the predetermined thickness of the aluminum alloy plate is at least 50.8 mm (2.0 inches), and preferably at least 63.5 mm (2.5 inches). In an embodiment the predetermined thickness of the aluminum alloy plate is at most 127 mm (5 inches), and preferably at most 114.3 mm (4.5 inches).

In an embodiment the 7xxx-series aluminum alloy has a composition comprising, in wt. %:

| | |
|---|---|
| Zn | 5.0% to 9.8%, preferably 5.5% to 8.7%, |
| Mg | 1.0% to 3.0%, |
| Cu | up to 2.5%, preferably 1.0% to 2.5%, |
| and optionally one or more elements selected from the group consisting of: | |
| Zr | up to 0.3%, |
| Cr | up to 0.3%, |
| Mn | up to 0.45%, |
| Ti | up to 0.15%, preferably up to 0.1%, |
| Sc | up to 0.5%, |
| Ag | up to 0.5%, |
| Fe | up to 0.25%, preferably up to 0.15%, |
| Si | up to 0.25%, preferably up to 0.12%, |
| impurities and balance aluminum. Typically, such impurities are present each <0.05% and total <0.15%. | |

The Zn is the main alloying element in 7xxx-series alloys, and for the method according to this invention it should be in a range of 5.0% to 9.7%. A preferred lower-limit for the Zn-content is about 5.5%, and more preferably about 6.2%. A preferred upper-limit for the Zn-content is about 8.7%, and more preferably about 8.4%.

Mg is another important alloying element and should be present in a range of 1.0% to 3.0%. A preferred lower-limit for the Mg content is about 1.2%. A preferred upper-limit for the Mg content is about 2.6%. A preferred upper-limit for the Mg content is about 2.4%.

Cu can be present in the 7xxx-series alloy up to about 2.5%. In one embodiment Cu is purposively added to increase in particular the strength and the SCC resistance and is present in a range of 1.0% to 2.5%. A preferred lower-limit for the Cu-content is 1.25%. A preferred upper-limit for the Cu-content is 2.3%.

In another embodiment the 7xxx-series alloy has a low Cu level of up to about 0.3%, providing a slight decrease in strength and SCC resistance, but increasing fracture toughness and ST-elongation.

The iron and silicon contents should be kept significantly low, for example not exceeding about 0.15% Fe, and preferably less than 0.10% Fe, and not exceeding about 0.15% Si and preferably 0.10% Si or less. In any event, it is conceivable that still slightly higher levels of both impurities, at most about 0.25% Fe and at most about 0.25% Si may be tolerated, though on a less preferred basis herein.

The 7xxx-series aluminum alloy comprises optionally one or more dispersoid forming elements to control the grain structure and the quench sensitivity selected from the group consisting of: Zr up to 0.3%, Cr up to 0.3%, Mn up to 0.45%, Ti up to 0.15%, Sc up to 0.5%, Ag up to 0.5%.

A preferred maximum for the Zr level is 0.25%. A suitable range of the Zr level is about 0.03% to 0.25%, and more preferably 0.05% to 0.18%. Zr is the preferred dispersoid forming alloying element in the aluminum alloy product according to this invention.

The addition of Sc is preferably not more than about 0.5% and more preferably not more than 0.3%, and more preferably not more than about 0.25%. A preferred lower limit for the Sc addition is 0.03%, and more preferably 0.05%.

In an embodiment, when combined with Zr, the sum of Sc+Zr should be less than 0.35%, preferably less than 0.30%.

Another dispersoid forming element that can be added, alone or with other dispersoid formers is Cr. Cr levels should preferably be below 0.3%, and more preferably at a maximum of about 0.25%. A preferred lower limit for the Cr would be about 0.04%.

In another embodiment of the aluminum alloy wrought product according to the invention it is free of Cr, in practical terms this would mean that it is considered an impurity and the Cr-content is up to 0.05%, and preferably up to 0.04%, and more preferably only up to 0.03%.

Mn can be added as a single dispersoid former or in combination with any one of the other mentioned dispersoid formers. A maximum for the Mn addition is about 0.4%. A practical range for the Mn addition is in the range of about 0.05% to 0.4%, and preferably in the range of about 0.05% to 0.3%. A preferred lower limit for the Mn addition is about 0.12%. When combined with Zr, the sum of Mn plus Zr should be less than about 0.4%, preferably less than about 0.32%, and a suitable minimum is about 0.12%.

In another embodiment of the aluminum alloy wrought product according to the invention it is free of Mn, in practical terms this would mean that it is considered an impurity and the Mn-content is up to 0.05%, and preferably up to 0.04%, and more preferably only up to 0.03%.

In another embodiment each of Cr and Mn are present only at impurity level in the aluminum alloy wrought product. Preferably the combined presence of Cr and Mn is only up to 0.05%, preferably up to 0.04%, and more preferably up to 0.02%.

Silver (Ag) in a range of up to 0.5% can be purposively added to further enhance the strength during ageing. A preferred lower limit for the purposive Ag addition would be about 0.05% and more preferably about 0.08%. A preferred upper limit would be about 0.4%.

In an embodiment the Ag is an impurity element and it can be present up to 0.05%, and preferably up to 0.03%.

Ti can be present, in particular, to act as a grain refiner during the casting of rolling feedstock. Ti based grain refiners such as those containing titanium and boron, or titanium and carbon, may also be used as is well-known in the art. The Ti-content in the aluminum alloy is up to 0.15%, and preferably up to 0.1%, and more preferably in a range of 0.01% to 0.05%.

In an embodiment the 7xxx-series aluminum alloy has a composition consisting of, in wt. %: Zn 5.0% to 9.8%, Mg 1.0% to 3.0%, Cu up to 2.5%, and optionally one or more elements selected from the group consisting of: (Zr up to 0.3%, Cr up to 0.3%, Mn up to 0.45%, Ti up to 0.15%, Sc up to 0.5%, Ag up to 0.5%), Fe up to 0.25%, Si up to 0.25%, balance aluminum and impurities each <0.05% and total <0.15%, and with preferred narrower compositional ranges as herein described and claimed.

In a further aspect the invention relates to an integrated monolithic aluminum structure manufactured by the method according to this invention.

In a further aspect the invention relates to an intermediate semi-finished product formed by the intermediate machined structure prior to the high-energy hydro forming operation.

In a further aspect the invention relates to an intermediate semi-finished product formed by the intermediate, and optionally pre-machined, structure having been high-energy hydroformed formed and having at least one of a uniaxial curvature and a biaxial curvature by the method according to this invention.

In a further aspect the invention relates to an intermediate semi-finished product formed by the intermediate, and optionally pre-machined, structure then high-energy hydroformed and having at least one of a uniaxial curvature and a biaxial curvature, and then solution heat-treated and cooled to ambient temperature.

In a further aspect the invention relates to an intermediate semi-finished product formed by the intermediate, and optionally pre-machined, structure then high-energy hydroformed and having at least one of a uniaxial curvature and a biaxial curvature, then solution heat-treated and cooled, stress relieved in a cold compression operation, and aged prior to machining into a near-final or final formed integrated monolithic aluminum structure, the ageing is to a desired temper to develop the required strength and other engineering properties relevant for the intended application of the integrated monolithic aluminum structure.

The aged and machined final integrated monolithic aluminum structure can be part of a structure like a fuselage panel with integrated stringers, cockpit of an aircraft, lateral windshield of a cockpit, integral lateral windshield of a cockpit, an integral frontal windshield of a cockpit, front bulkhead, door surround, nose landing gear bay, and nose fuselage. It can also be as part of an underbody structure of an armored vehicle providing mine blast resistance, the door of an armored vehicle, the engine hood or front fender of an armored vehicle, a turret.

In a further aspect the invention relates to the use of a 7xxx-series aluminum alloy plate in an F-temper or an O-temper, having a composition of, in wt. %, Zn 5.0% to 9.8%, Mg 1.0% to 3.0%, Cu up to 2.5%, and optionally one or more elements selected from the group consisting of: (Zr up to 0.3%, Cr up to 0.3%, Mn up to 0.45%, Ti up to 0.15%, Sc up to 0.5%, Ag up to 0.5%), Fe up to 0.25%, Si up to 0.25%, balance aluminum and impurities each <0.05% and total <0.15%, and with preferred narrower compositional ranges as herein described and claimed, and a gauge in a range of 38.1 mm to 127 mm in a high-energy hydroforming operation according to this invention, and preferably to produce an aircraft structural part.

BRIEF DESCRIPTION OF THE DRAWINGS

The invention shall also be described with reference to the appended drawings, in which.

DETAILED DESCRIPTION OF THE PREFERRED EMBODIMENTS

Figure 1:
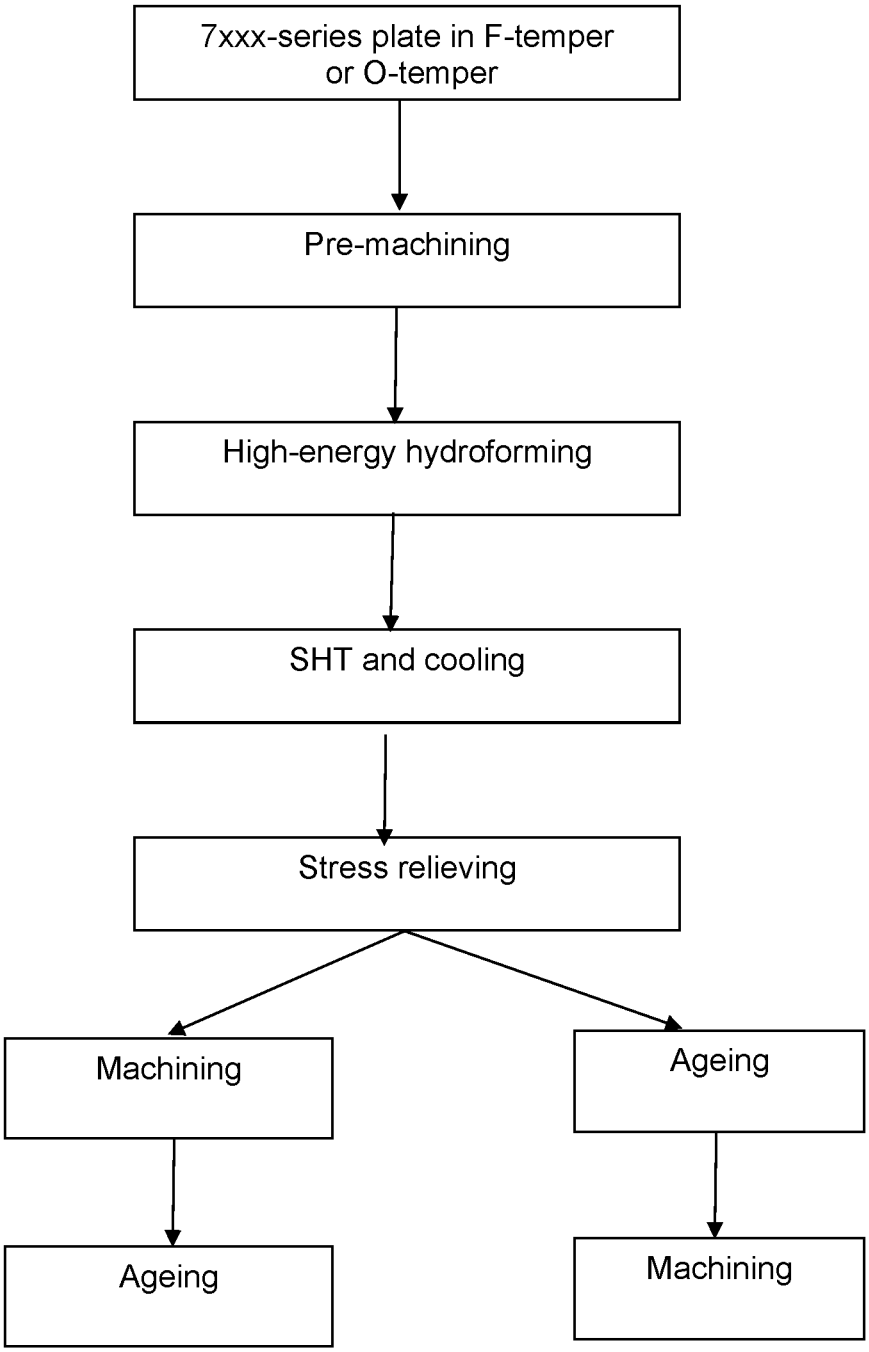
FIG. 1 shows a flow chart illustrating one embodiment of the method according to this invention.

In FIG. 1 the method comprises, in that order, a first process step of providing an 7xxx-series aluminum alloy plate material in an F-temper or O-temper and having a predetermined thickness of at least 38.1 mm. In a next process step the plate material is pre-machined (this is an optional process step) into an intermediate machined structure and subsequently high-energy hydroformed, preferably by means of explosive forming or electrohydraulic forming, into a high-energy hydroformed structure with least one of a uniaxial curvature and a biaxial curvature. In a next process step there is solution heat-treating ("SHT") and cooling of the high-energy hydroformed structure. In a preferred embodiment following SHT and cooling the intermediate product is stress relieved, more preferably in an operation including in a cold compression type of operation.

Then there is either machining or mechanical milling of the solution heat-treated high-energy formed structure to a near-final or final machined integrated monolithic aluminum structure, followed by ageing of the machined integrated monolithic aluminum structure to a desired temper to develop the required strength and other engineering properties relevant for the intended application of the integrated monolithic aluminum structure.

Or, in an alternative embodiment, there is firstly ageing of intermediate integrated monolithic aluminum structure to a desired temper to develop the required strength and other engineering properties relevant for the intended application of the integrated monolithic aluminum structure, for example an T7452 or T7652 temper, followed by machining or mechanical milling of the aged high-energy formed structure into a near-final or final machined integrated monolithic aluminum structure.

Figure 2:
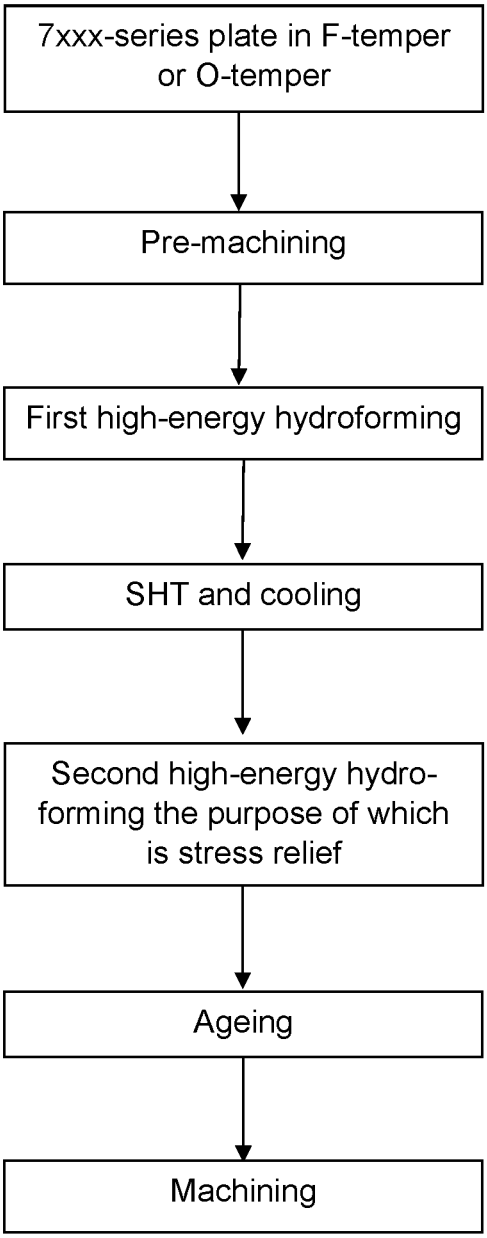
FIG. 2 shows a flow chart illustrating another embodiment of the method according to this invention.

The method illustrated in FIG. 2 is closely related to the method illustrated in FIG. 1, except that in this embodiment there is a first high-energy hydroforming step, followed by a solution heat-treatment and cooling. Then at least one second high-energy hydroforming step is performed, the purpose of which is at least stress relief, followed by the ageing and machining as in the method illustrated in FIG. 1.

Figure 3C:
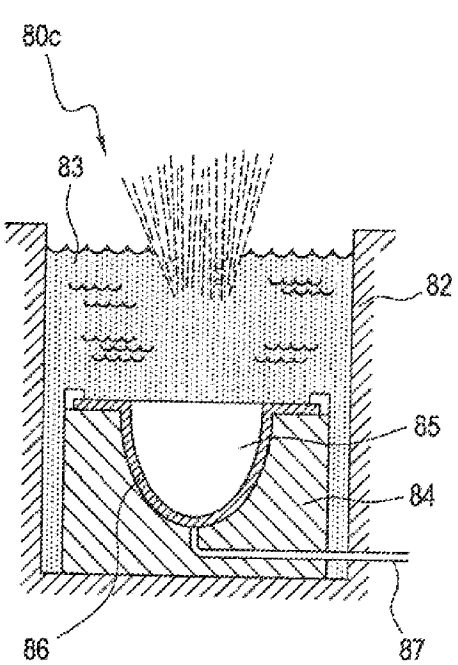
FIGS. 3A, 3B and 3C show cross-sectional side-views of an aluminum plate progressing through stages of a forming process from a rough-shaped metal plate into a shaped, near-finally shaped and finally-shaped workpiece, according to aspects of the present invention.
Figure 3B:
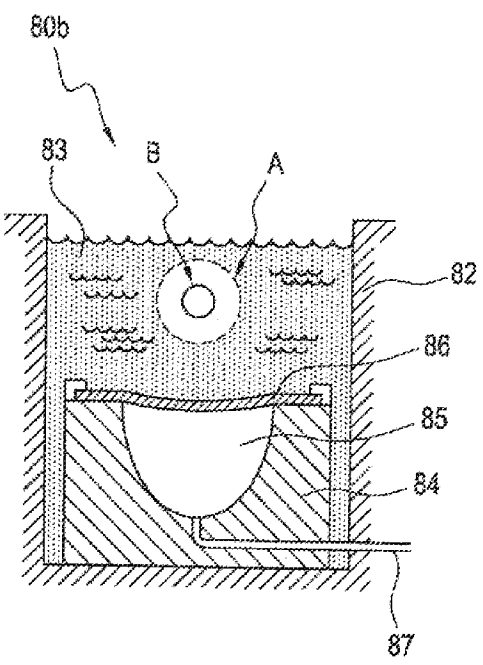
Figure 3A:
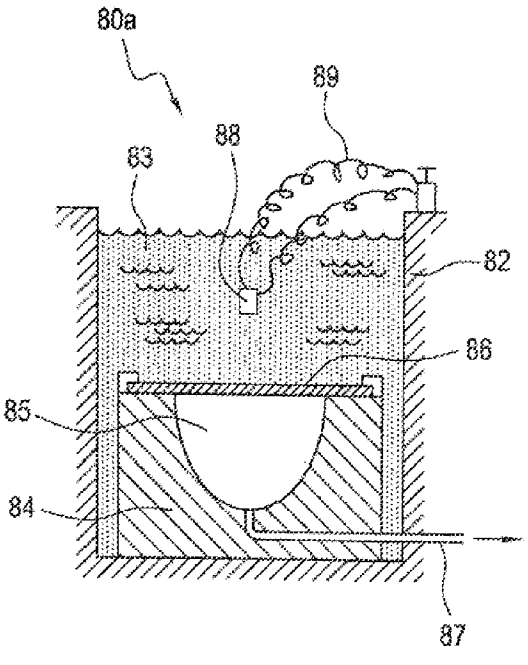

FIGS. 3A, 3B and 3C show a series in progression of exemplary drawings illustrating how an aluminum plate may be formed during an explosive forming process that can be used in the forming processes according to this invention. According to an explosive forming assembly 80*a*, a tank 82 contains an amount of water 83. A die 84 defines a cavity 85 and a vacuum line 87 extends from the cavity 85 through the die 84 to a vacuum (not shown). Aluminium plate 86*a* is held in position in the die 84 via a hold-down ring or other retaining device (not shown). An explosive charge 88 is shown suspended in the water 83 via a charge detonation line 89, with charge detonation line 19*a* connected to a detonator (not shown). As shown in FIG. 3B, the charge 88 (shown in FIG. 3A) has been detonated in explosive forming assembly 80*b* creating a shock wave "A" emanating from a gas bubble "B", with the shock wave "A" causing the deformation of the aluminum plate 86*b* into cavity 85 until the aluminum plate 86*c* is driven against (e.g., immediately proximate to and in contact with) the inner surface of die 84 as shown in the explosive forming assembly 80*c* of FIG. 3C.

Having now fully described the invention, it will be apparent to one of ordinary skill in the art that many changes and modifications can be made without departing from the spirit or scope of the invention as herein described.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A method of producing an integrated monolithic aluminum structure, the method comprising the steps of:

providing an aluminum alloy plate with a predetermined thickness of at least 38.1 mm, wherein the aluminum alloy plate is a 7xxx-series alloy provided in an F-temper or an O-temper;

optionally pre-machining of the aluminum alloy plate to an intermediate machined structure;

high-energy hydroforming of the plate or optional intermediate machined structure into a high-energy hydroformed structure against a forming surface of a rigid die having a contour in accordance with a desired curvature of the integrated monolithic aluminum structure, the high-energy hydroforming causing the plate or the intermediate machined structure to conform to the contour of the forming surface to at least one of a uniaxial curvature and a biaxial curvature;

solution heat-treating and cooling of the high-energy hydroformed structure;

machining of the solution heat-treated high-energy formed structure to a final machined integrated monolithic aluminum structure; and ageing of the final integrated monolithic aluminum structure to a desired temper, wherein said solution heat-treated structure is stress-relieved by compressive forming in a next high-energy hydroforming step.

2. The method according to claim 1, wherein following solution heat-treating and cooling of the high-energy hydroformed structure, in that order, the solution heat-treated high-energy formed structure is machined to a final machined integrated monolithic aluminum structure and then aged to a desired temper.

3. The method according to claim 1, wherein following solution heat-treating and cooling of the high-energy hydroformed structure, in that order, the solution heat-treated high-energy formed structure is aged to a desired temper and then machined to a final machined integrated monolithic aluminum structure.

4. The method according to claim 1, wherein following solution heat-treating and cooling of the high-energy hydroformed structure, said solution heat-treated structure is stress-relieved, by compressive forming, followed by machining and ageing to a desired temper of the integrated monolithic aluminum structure.

5. The method according to claim 1, wherein following solution heat-treating and cooling of the high-energy hydroformed structure, said solution heat-treated structure is stress-relieved, followed by machining and ageing to a desired temper of the integrated monolithic aluminum structure.

6. The method according to claim 1, wherein the predetermined thickness of the aluminum alloy plate is at least 50.8 mm.

7. The method according to claim 1, wherein the predetermined thickness of the aluminum alloy plate is between 38.1 mm and at most 127 mm.

8. The method according to claim 1, wherein the ageing of the integrated monolithic aluminum structure is to a desired temper selected from the group of: T4, T5, T6, and T7.

9. The method according to claim 1, wherein the ageing of the integrated monolithic aluminum structure is to a T7 temper.

10. The method according to claim 1, wherein the 7xxx-series aluminum alloy has a composition comprising, in wt. %:

| | |
|---|---|
| Zn | 5.0% to 9.8%, |
| Mg | 1.0% to 3.0%, |
| Cu | up to 2.5%. |

11. The method according to claim 1, wherein the 7xxx-series aluminum alloy has a composition comprising, in wt. %:

| | |
|---|---|
| Zn | 5.0% to 9.8%, |
| Mg | 1.0% to 3.0%, |
| Cu | up to 2.5% |
| and optionally one or more elements selected from the group consisting of: | |
| Zr | up to 0.3%, |
| Cr | up to 0.3%, |
| Mn | up to 0.45%, |
| Ti | up to 0.1%, |
| Sc | up to 0.5%, |
| Ag | up to 0.5%, |
| Fe | up to 0.25%, |
| Si | up to 0.25%, |
| impurities and balance aluminum. | |

12. The method according to claim 1, wherein the 7xxx-series aluminum alloy has a Cu-content of 1.0% to 2.5%.

13. The method according to claim 1, wherein the 7xxx-series aluminum alloy has a Cu-content of up to 0.3%.

14. The method according to claim 1, wherein the solution heat-treatment is at a temperature in a range of 400° C. to 560° C.

15. The method according to claim 1, wherein the pre-machining and final machining comprises high-speed machining.

16. A method of producing an aircraft structural part by producing an integrated monolithic aluminum structure according to the method of claim 1.

* * * * *